US007604143B2

(12) United States Patent
Kerekes, Jr.

(10) Patent No.: US 7,604,143 B2
(45) **Date of Patent: *Oct. 20, 2009**

(54) BAG HOLDER

(76) Inventor: John L. Kerekes, Jr., 13409 Cloverdale Pl., Germantown, MD (US) 20874

( * ) Notice: Subject to any disclaimer, the term of this patent is extended or adjusted under 35 U.S.C. 154(b) by 696 days.

This patent is subject to a terminal disclaimer.

(21) Appl. No.: 11/159,112

(22) Filed: Jun. 23, 2005

(65) Prior Publication Data

US 2006/0289544 A1 Dec. 28, 2006

(51) Int. Cl.
*B65D 25/14* (2006.01)

(52) U.S. Cl. ..... 220/495.08; 141/114; 141/314; 141/328; 141/369; 141/337; 248/99

(58) Field of Classification Search ..... 141/10, 141/114, 231, 312, 313, 314, 328, 369, 337; 248/95, 97, 98, 99, 100, 101; 220/495.01, 220/495.08

See application file for complete search history.

(56) References Cited

U.S. PATENT DOCUMENTS

| | | | | |
|---|---|---|---|---|
| 186,918 | A | 2/1877 | Allen | |
| 207,412 | A * | 8/1878 | Friedriech | 248/99 |
| 578,261 | A | 3/1897 | Palmer | |
| 756,693 | A * | 4/1904 | Parr | 141/390 |
| 989,642 | A | 4/1911 | Raw | |
| 2,042,858 | A * | 6/1936 | Nicolas | 248/101 |
| 2,064,848 | A | 12/1936 | Neuman | |
| 2,758,764 | A * | 8/1956 | Piazze | 141/166 |
| 3,106,303 | A | 10/1963 | Fiocchiaro | |
| 3,170,183 | A | 2/1965 | Leatherman | |
| 3,697,030 | A | 10/1972 | Schultz | |
| 3,754,785 | A | 8/1973 | Anderson | |
| 3,934,803 | A | 1/1976 | Paulus | |
| 3,992,034 | A * | 11/1976 | Smith et al. | 280/654 |
| 4,006,928 | A | 2/1977 | Beugin | |
| 4,021,994 | A | 5/1977 | Mainprice | |
| 4,157,801 | A | 6/1979 | Elmer | |
| 4,159,139 | A | 6/1979 | Gawedzinski | |
| 4,174,085 | A | 11/1979 | Ferreira et al. | |
| 4,202,521 | A | 5/1980 | Harding | |
| 4,281,813 | A | 8/1981 | Garrity | |
| 4,287,701 | A | 9/1981 | Washington | |
| 4,299,365 | A | 11/1981 | Battle | |
| 4,318,521 | A | 3/1982 | Martin et al. | |

(Continued)

OTHER PUBLICATIONS http://www.whipperclipper.com/bag_holder.htm.

(Continued)

*Primary Examiner*—Timothy L Maust
*Assistant Examiner*—Jason K Niesz
(74) *Attorney, Agent, or Firm*—Michele V. Frank; Patton Boggs LLP

(57) ABSTRACT

A holder for a bag. The holder comprises a stand or trash can and chute elements rotatably engaged to the stand or trash can. The chute elements are for opening the bag when frictionally engaging interior surfaces of the bag. The chute elements comprise a first pair and a second pair of chute elements. Each of the first pair of chute elements have stop elements for limiting rotation on the stand or trash can of each of the second pair of chute elements, when each of the first pair of chute elements has engaged sides of the bag in the holder.

12 Claims, 5 Drawing Sheets

U.S. PATENT DOCUMENTS

| | | | |
|---|---|---|---|
| 4,354,543 | A | 10/1982 | Bogner |
| 4,372,512 | A | 2/1983 | Wolfe |
| 4,442,567 | A | 4/1984 | Pravettone |
| 4,457,483 | A | 7/1984 | Gagne |
| 4,469,300 | A | 9/1984 | Valesko |
| 4,497,344 | A | 2/1985 | Kisiel |
| 4,562,983 | A | 1/1986 | Klefbeck |
| 4,593,873 | A | 6/1986 | Nelson |
| 4,615,743 | A | 10/1986 | Bylenga |
| 4,638,967 | A | 1/1987 | MacDuffee |
| 4,664,348 | A | 5/1987 | Corsaut, III et al. |
| 4,684,087 | A | 8/1987 | Spickard |
| 4,702,445 | A | 10/1987 | Ivory |
| 4,749,158 | A | 6/1988 | Buckley |
| 4,760,932 | A | 8/1988 | Rhodes, Jr. |
| 4,783,031 | A | 11/1988 | Ebentheuer |
| 4,856,740 | A | 8/1989 | MacLeod et al. |
| 4,927,104 | A | 5/1990 | Miller |
| 4,940,201 | A | 7/1990 | Kurth |
| 4,951,903 | A | 8/1990 | Frey |
| 4,976,406 | A | 12/1990 | Buckley et al. |
| 4,981,274 | A | 1/1991 | McVay et al. |
| 4,998,694 | A | 3/1991 | Barteaux |
| 5,069,405 | A | 12/1991 | Keating |
| 5,138,226 | A | 8/1992 | Johnson |
| 5,180,126 | A | 1/1993 | Bennett |
| 5,183,339 | A | 2/1993 | Williams |
| 5,222,536 | A | 6/1993 | Hodgdon et al. |
| 5,570,862 | A | 11/1996 | Nugent |
| 5,593,117 | A | 1/1997 | Alexander, III |
| 5,597,022 | A | 1/1997 | Reifers |
| 5,615,853 | A | 4/1997 | Hearst |
| 5,641,138 | A | 6/1997 | Cronk et al. |
| 5,707,030 | A | 1/1998 | Roman |
| 5,711,563 | A | 1/1998 | Sapp |
| 5,716,033 | A | 2/1998 | Gibson |
| 5,718,400 | A | 2/1998 | Dwy |
| 5,735,495 | A | 4/1998 | Kubota |
| 5,738,314 | A | 4/1998 | Davis |
| 5,738,315 | A | 4/1998 | Kent, Jr. |
| 5,743,651 | A | 4/1998 | Steinmetz |
| 2005/0103950 | A1 | 5/2005 | Joubert |
| 2005/0103951 | A1 | 5/2005 | Metcalfe |

OTHER PUBLICATIONS http://www.whipperclipper.com/bag_holder.htm, First Published Dec. 1, 2001.

* cited by examiner

BAG HOLDER

FIELD OF THE INVENTION

This invention relates to bag holders. Specifically, this is a portable bag holder that maintains a bag in an open position for the introduction and containment of waste or other material.

DESCRIPTION OF THE RELATED ART

Over time, there have been a number of devices for holding trash. These devices range from a fully reusable trash can to devices for retaining and supporting trash bags.

But, what is needed is a new type of device that effectively addresses the unique challenges of handling a wide variety of bags. This includes, among other things, holding and supporting the bag upright, maintaining the mouth of the bag in a fully open position, protecting the full perimeter of the vulnerable bag mouth against snagging and tearing, and guiding material into the bag so that spillage may be minimized.

SUMMARY OF THE INVENTION

One embodiment of the present invention provides a holder for a bag, comprising a stand, and chute elements rotatably engaged to the stand, for opening the bag when frictionally engaging interior surfaces of the bag, wherein the chute elements comprise a first pair and a second pair of chute elements, each of the first pair of chute elements having stop elements for limiting rotation on the stand of each of the second pair of chute elements, when each of the first pair of chute elements has engaged sides of the bag in the holder.

In one aspect of the invention, the stop elements comprise curved edges on ends of the first pair of chute elements which respectively overlap ends of the second pair of chute elements. In another aspect of the invention, the edge may be curved at opposite ends to prevent piercing the bag. Further, in another aspect of the invention, the chute elements may be adapted to cover an entire perimeter of a mouth of the bag. In still another aspect of the invention, the first pair and the second pair of chute elements have engagement elements for maintaining the second pair of chute elements in engagement with the first pair of chute elements, and the edge portion in engagement with the bag, after rotation of the second pair of chute elements has been limited by the stop elements. In another aspect of the invention, the engagement elements comprises a pair of detents on opposite ends of each of the first pair of chute elements which engage beveled edges on opposite ends of each of the second pair of chute elements. In another aspect of the invention, the engagement elements comprise a pair of bumps on opposite ends of each of the first pair of chute elements which engage beveled edges on opposite ends of each of the second pair of chute elements.

In a further aspect of the invention, the engagement elements provide force to keep a bag open. In still another aspect of the invention, the first pair of chute elements may be longer than the second pair of chute elements and wherein a lower portion of the first pair of chute elements contact the bag sufficiently below the top edge of the bag so that essentially no force is applied to the mouth of the bag. In another aspect of the invention, the lower portion of the first pair of chute elements may be angled outwardly to apply force to the bag. In another aspect of the invention, the angle may be approximately 45 degrees. In still another aspect of the invention, a height of the stand may be at least as long as a length of the bag when opened or in the holder. In another aspect of the invention, the first pair of chute elements may be made from an elastically deformable material while in another aspect of the invention, the second pair of chute elements force the first pair of chute elements to deform.

The present invention also provides a trash can with a holder for a bag comprising a trash can body; and a lid, the lid comprising chute elements rotatably engaged to the lid, for opening the bag when frictionally engaging interior surfaces of the bag, wherein the chute elements comprise a first pair and a second pair of chute elements, each of the first pair of chute elements having stop elements for limiting rotation on the stand of each of the second pair of chute elements, when each of the first pair of chute elements has engaged the bag in the holder.

In another aspect of the invention, the trash can further comprises wheels and a handle. In another aspect of the invention, the stop elements comprise curved edges on ends of the first pair of chute elements which respectively overlap ends of the second pair of chute elements. In another aspect of the invention, the edge may be curved at opposite ends to prevent piercing the bag. Further, in another aspect of the invention, the chute elements may be adapted to cover an entire perimeter of a mouth of the bag. In still another aspect of the invention, the first pair and the second pair of chute elements have engagement elements for maintaining the second pair of chute elements in engagement with the first pair of chute elements, and the edge portion in engagement with the bag, after rotation of the second pair of chute elements has been limited by the stop elements. In another aspect of the invention, the engagement elements comprises a pair of detents on opposite ends of each of the first pair of chute elements which engage beveled edges on opposite ends of each of the second pair of chute elements. In another aspect of the invention, the engagement elements comprises a pair of bumps on opposite ends of each of the first pair of chute elements which engage beveled edges on opposite ends of each of the second pair of chute elements. In another aspect of the invention, the first pair of chute elements engage the interior of the bag and press the exterior of the bag against the interior surface of the trash can.

In a further aspect of the invention, the engagement elements provide force to keep a bag open. In still another aspect of the invention, the first pair of chute elements may be longer than the second pair of chute elements and wherein a lower portion of the first pair of chute elements contact the bag sufficiently below the top edge of the bag so that essentially no force is applied to the mouth of the bag. In another aspect of the invention, the lower portion of the first pair of chute elements may be angled outwardly to apply force to the bag. In another aspect of the invention, the angle may be approximately 45 degrees. In still another aspect of the invention, a height of the stand may be at least as long as a length of the bag when opened or in the holder. In another aspect of the invention, the first pair of chute elements may be made from an elastically deformable material while in another aspect of the invention, the second pair of chute elements force the first pair of chute elements to deform.

The present invention also provides a holder for a bag, comprising chute elements adapted to rotatably engage the bag for opening the bag when frictionally engaging interior surfaces of the bag, wherein the chute elements comprise at least a first chute element having an engagement element that imparts force to at least a second chute element, the second chute element providing force to keep the bag open.

In one aspect of the invention, at least one of the chute elements has a stop element for limiting rotation of the chute elements, when the chute elements have engaged sides of the bag in the holder. In another aspect of the invention, the stop elements comprise curved edges on ends of the first chute element which overlap ends of the second chute element. In a further aspect of the invention, the edge may be curved at opposite ends to prevent piercing the bag. In still another aspect of the invention, the chute elements may be adapted to cover an entire perimeter of a mouth of the bag. In another aspect of the invention, the first chute element has an engagement element for maintaining the second chute element in engagement with the first chute element, and the edge in engagement with the bag, after rotation of the second chute element has been limited by the stop element. In another aspect of the invention, the first chute element may be longer than the second chute element and wherein a lower portion of the first chute element contacts the bag substantially below the top edge of the bag.

In another aspect of the invention, the lower portion of the first pair of chute elements may be angled outwardly to apply force to the bag. In a further embodiment of the invention, the angle may be approximately 45 degrees. In another aspect of the invention, at least one of the chute elements may be made from an elastically deformable material. In still one other aspect of the invention, at least one chute element forces another of the chute elements to deform.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION OF THE EMBODIMENTS

Figure 1:
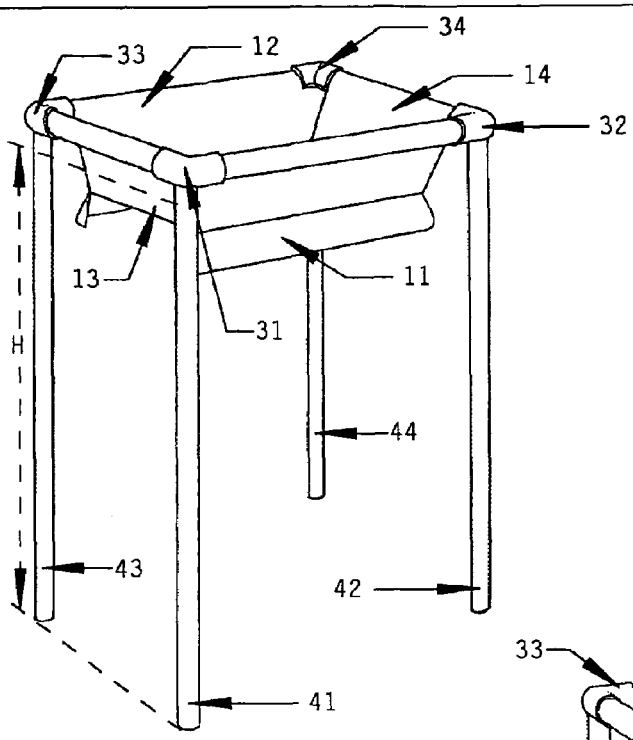
FIG. 1 shows a perspective view of a first embodiment of the bag holder according to the invention with the bag omitted for purposes of clarity.

The present invention is directed to a bag holder designed to hold the bag open while the bag is being filled. The present invention can include several chute elements adapted to rotatably and frictionally engage the bag to support it and hold it open. At least one chute element has an engagement element that imparts force to at least one other chute element. Together, the chute elements impart force on the bag to keep the bag open. In two of the exemplary embodiments of the invention, the bag holder includes two pairs of chute elements, four chute elements in all. These embodiments can be used with any type of bag including bags having four sides. The present invention, however, is not limited to four chute elements. For example, more or less than four chute elements can be used. Preferably, the chute elements are in pairs, however, an odd number of chute element is within the scope of the invention.

The bag holder in accordance with the invention preferably insures that the perimeter of the bag opening is preferably not torn during the processes of mounting a new bag. In order to accomplish this, the invention utilizes no hooks to tear the bag, no clips to concentrate stress at limited areas, and does not require working the bag around a circumferentially large chute, which can tear the bag. Instead, the invention's chute can be widely expanded out of the way to admit the bag to the holder. The chute may be then collapsed before it is inserted into the mouth of a bag, it may then expanded, placing outward force against the inside of the bag, thus holding the bag open and upright. This force can be distributed over a large area that may be a sufficient distance below the vulnerable top edge of the bag, so as not to tear the bag.

This outward force may be buffered and maintained by the flexible nature of the chute elements. This ensures that a constant, evenly applied force may be placed against the interior surface of the bag to hold the bag in place, but a force not so great as to cause the bag to rupture or tear. The chute elements' lower side edges that contact the bag are also curved, to preferably insure that the bag is not cut, pierced or torn by sharp corners or edges.

This invention also protects the bag against tearing during the act of adding material to the bag. The chute in this invention accomplishes this by providing protection for the bag opening over its full periphery. Preferably, none of the bag's top edge is exposed to damage once the chute is moved into position. Consequently twigs, grass clippings, and/or other material or tools can not snag the top of the bag while the material is being loaded and tear the bag. In order to open, hold and protect a bag, this invention, unlike prior devices, utilizes a unique chute design that may be lightweight, simple and convenient to operate, and economical to manufacture.

Rather than use the ratchets, racks and pinions, coil springs, turnbuckles, screw-like devices or telescoping components of prior devices, this invention uses none of them.

Many of these parts may break down, injure the operator, puncture or tear the bag, become separated or lost, or are difficult to operate. They also add weight, complexity, cost, or otherwise diminish the utility of a bag holder.

The principles of the invention can be implemented in a number of embodiments. One embodiment of the invention is directed to a four-piece chute that is suitable to hold open four sided bags. Preferably, this embodiment includes two pairs of simple, identical parts. Each part can be a single element, composed of plastic, metal, and/or other suitable material. The chute components can be contained within hinge pin elements, also of simple construction such as hollow plastic tubes. These hinge pin elements can be joined at the comers by connecting elements. Together, these hinge pin elements and connecting elements may define the perimeter of the chute's top opening. The hinge pin elements and connecting elements can be raised the necessary height above the ground by sufficiently rigid legs, a can, cylinder or other suitable support. The support may have any combination of wheels, castors, and/or feet, and/or a handle, or be incorporated onto other carts, trucks or devices, to facilitate repositioning the invention during use. For example, the chute elements may be incorporated in a trash can-like structure molded on the bed on the back of a golf or janitor's cart. Further, the legs may be placed on or affixed to a flat board or piece of sheet metal to more readily allow the holder to slide around the yard or workplace. Additionally, the legs, can or cylinder also serve to maintain the chute opening perpendicular to the ground in situations where the holder is laid on its side.

The chute elements can have a hinge area that curls sufficiently around or embraces the hinge pin elements. This hinge area holds each chute element to its respective hinge pin element, yet permits the rotation of each chute element downward into the top opening of a bag in order to seize the bag in position. The chute elements may also be rotated upward and out of the bag, in order to release a bag from the stand, or to insert a new bag.

The hinge area can be made so that it tends to squeeze the perimeter hinge pin elements, embracing them by a friction fit so that each chute element will remain stationary in whatever position the operator chooses, yet each may be easily repositioned by the hand action of the operator.

The chute elements also can have smooth sides that preferably, when they are locked into position inside the mouth of a bag, form a chute that extends down into the mouth of the bag. This both protects the top edge of the bag mouth, and provides a funnel to facilitate the introduction of material into the bag. The chute elements may also be constructed to extend upward and outward beyond the hinge elements, to form a larger funnel opening to more readily facilitate the introduction of material into the bag.

In accordance with the principals of the invention, the chute elements reach into the bag sufficiently below the top of the bag such that there is essentially no force applied to the mouth of the bag. In one embodiment of the invention, the two pairs of chute elements differ. The two long chute elements reach deeper down into the mouth of the bag than do the two short chute elements. In this embodiment, it is these two long chute elements that directly contact the interior surfaces of the bag below the top of the bag, and hold the bag open.

Alternatively, the chute elements may have varying lengths or may be all the same length. However, it is not necessary for any of the chute elements to have the same length as any other chute element. Therefore each of the chute elements may have different lengths. Some, all, or any combination of chute elements may extend into the bag sufficiently below the top of the bag such that essentially no force is applied to the mouth of the bag. Direct contact of the interior surfaces of the bag can be accomplished by angling the bottom portion of each long chute element outwards, to locate the opening force away from the very top edge of the bag. Any of the long chute elements may be made from elastically deformable material and/or possibly thinned where flexibility is desired, as discussed in more detail with reference to the figures.

The long chute elements can have curved regions near the ends of their line of contact with the bag interior. This is to prevent concentrating force along a sharp comer or edge that might cut or tear the bag. These curved regions ensure a more diffuse, less concentrated application of force.

The long chute elements can also be flexible enough near their line of contact with the bag so that a constant, outward force may be maintained on the bag. This force can be strong enough to keep the bag open and seize it to the chute, yet there can be sufficient compliance in the long chute elements to prevent the application of excessive force from tearing the bag. This compliance also compensates for variations in the size of the bag openings. This area of contact with the bag may also be coated with rubber, grit or other substances, or serrated, so that there is increased friction or traction on the bag, aiding in holding the bag in position. Additionally, this area may be radiused or curved away from the bag to expose a greater surface area of the long chute elements to contact with a greater surface area of the bag, providing increased friction with the bag, and reducing chances of piercing, cutting or tearing the bag.

The two long chute elements may include a locking mechanism, for example they can also have appropriately located raised bumps, that prevent the short chute elements from inadvertently popping out of position, yet permit the easy release of the short chute elements by the hand action of the operator to permit removal of a bag from the stand.

Lastly, the two long chute elements can have curved sides. These elements can seal the corners of the chute while a bag may be gripped in the stand, further protecting the bag, and preventing leakage while material is added to the bag, and serve to limit the travel of the short chute elements.

The outward force upon the long chute elements can be provided by the pair of short chute elements. These two short chute elements can be constructed so that, by the act of lowering them into the bag mouth, they provide a force on the inside of the long chute elements that pushes the long chute elements outward or away from each other. This force may be then transmitted to the bag. It is this force that causes the long chute elements to flex, storing energy, and maintaining force upon the bag which holds the bag open and upright.

Taken together, the chute elements and hinge pin elements can comprise a unique system for opening and holding a bag. In accordance with the principles of the invention, a bag may be loaded into position from the top, rather than from below a chute and held open and in position for receiving material. This makes the task of mounting a bag far easier to accomplish, requiring no stooping, stretching, reaching, or struggling.

In actual operation, an operator accomplishes the following steps in order. First, the holder may be placed upon a surface. Any surface will suffice, as long as it provides a sufficiently stable and level area to prevent tipping of the stand. Next, the operator rotates all of the chute elements upward and outward on their respective hinge pin elements to provide a clear path through which to insert a fresh bag. Thirdly, the operator obtains a new bag, and opens or expands the bag to its full, open shape. Next, the operator lowers or drops the newly expanded bag down through the opening defined by the hinge pin elements. Depending upon the size, the bottom of the bag may rest upon the surface upon which the stand has been set.

Now that the bag is in the stand, the operator in turn rotates and lowers each long chute element on its respective hinge pin element into the mouth of the bag. This is best accomplished by utilizing one hand to steady the bag mouth, and using the other hand to rotate the long chute element into position inside the mouth of the bag. This process may then repeated for the other long chute element.

Once the two long chute elements are in position, the operator, again using the hands, rotates the two short chute elements on their respective hinge pin elements downward into the bag mouth. This action may be continued until each short chute element is in position, for example, until each short chute element passes just beyond the raised bumps on the long chute elements, and comes to rest against the curved regions along the upper side edges of the long chute elements. This action may be accomplished either serially, or simultaneously. The action of lowering the short chute elements causes the two long chute elements to spread apart, imparting an outward or expanding force against the interior surface of the bag. This outward force holds the bag open, and maintains it upright in the stand. The bag is now ready to be filled with material.

To release a bag from the holder, first simply rotate the two short chute elements upward and outward, then rotate the two long chute elements upward and outward. The bag may then either be lifted up and out of the holder, or dragged to the side out from under the holder.

This invention securely holds bags for filling, and is useful, economical, reliable, lightweight, portable, and simple to operate by a solo individual of ordinary dexterity.

Illustrated Embodiments

FIG. 1 shows the complete first embodiment of the invention, which includes four leg elements 41-44 engaged to four connecting elements 31-34, the four connecting elements 31-34 engaged to four hinge pin elements 21-24, with four chute elements 11-14 rotatably engaged on hinge pin elements 21-24.

In FIG. 1, the four chute elements 11-14 are in position for holding a bag for filling, the bag having been omitted for clarity. The length of leg elements 41-44 may be sized accordingly, such that the chute elements 11-14 extend down below the mouth of the bag while the bag remains fully opened.

Figure 2:
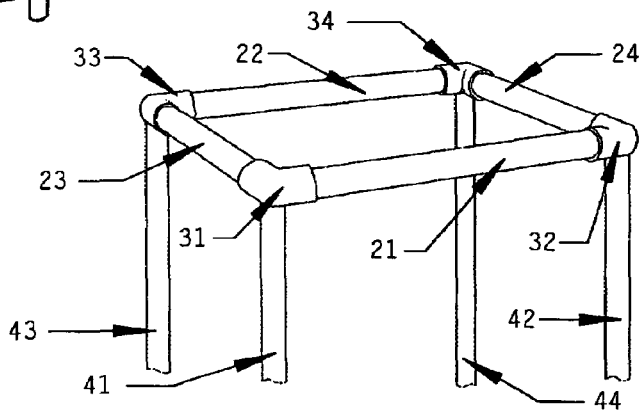
FIG. 2 shows a partial perspective view of the bag holder of FIG. 1 with the chute omitted for clarity.

FIG. 2 shows a partial perspective view of the embodiment of FIG. 1, with the chute elements omitted for clarity. Preferably, hinge pin elements 21-24 are of sufficient length to permit a fully opened bag to pass unobstructed through the rectangle defined by the assembly of hinge pin elements 21-24 and connecting elements 31-34.

Figure 3:
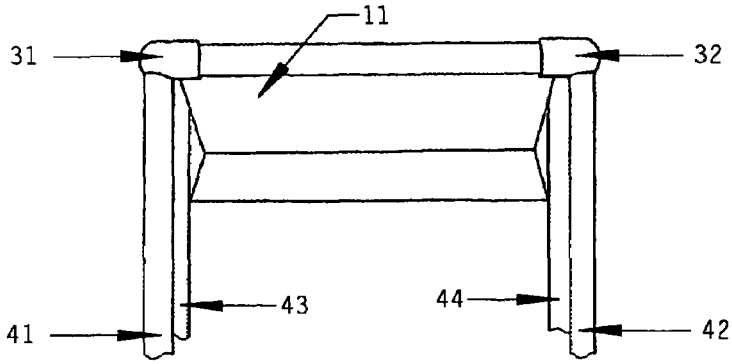
FIG. 3 shows a partial elevation view of one side of the bag holder of FIG. 1.

FIG. 3 shows a partial elevation view of the longer side width of the bag holder of FIG. 1. Long chute element 11 is clearly shown, and may be made to a width such that it frictionally embraces substantially the entire length of hinge pin element 21 that extends between connecting elements 31 and 32.

Figure 4:
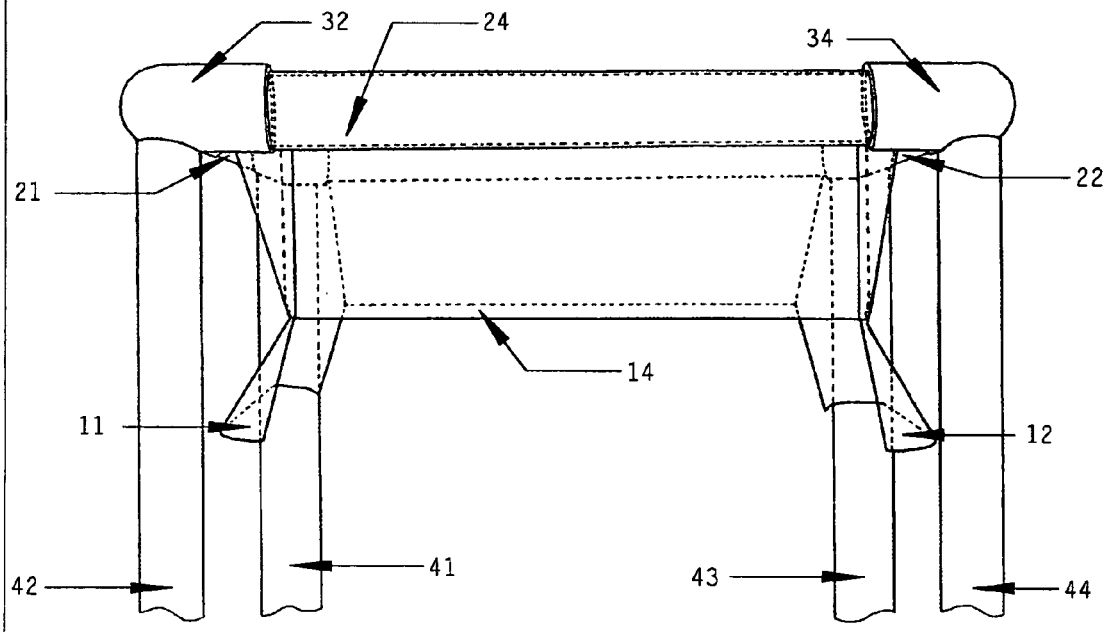
FIG. 4 shows a partial elevation view of another side of the bag holder of FIG. 1.

FIG. 4 shows a partial elevation view of the shorter side width of the bag holder of FIG. 1. Short chute element 14 is clearly shown, and may be made to a width such that it frictionally embraces substantially the entire length of hinge pin element 24 that extends between connecting elements 32 and 34. Also shown is the relationship between long chute elements 11 and 12 and short chute element 14. In this figure, the chute elements are in position for holding a bag for filling.

Figure 5:
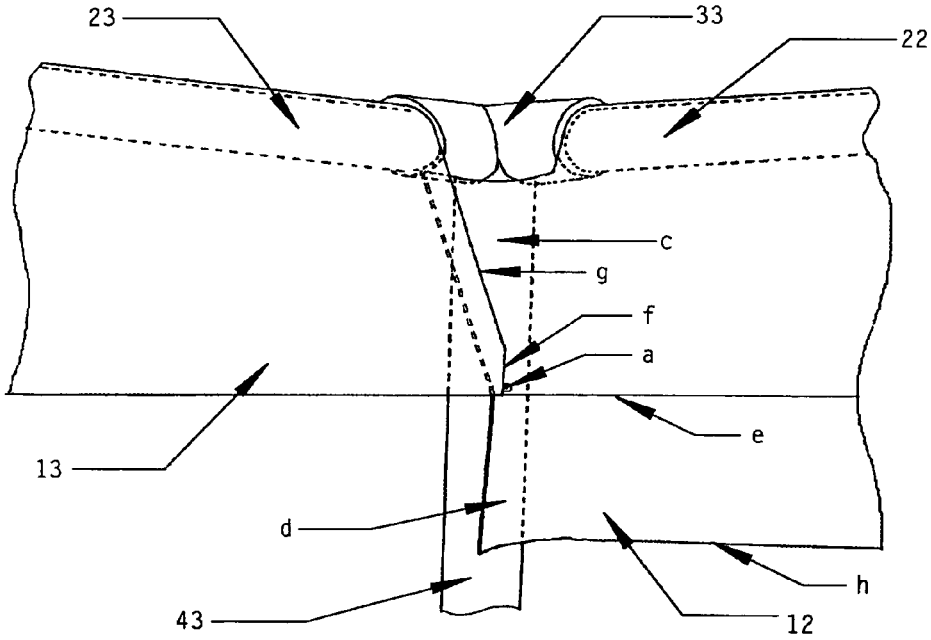
FIG. 5 shows an elevation view of a comer of the bag holder of FIG. 1 with the chute engaged.

FIG. 5 shows a perspective view of long chute element 12 of the chute in engagement with short element 13 of the chute, according to the first embodiment of the invention. In this figure, the chute elements are in position for holding a bag for filling. Short chute element 13 is shown rotatably engaged with hinge pin element 23, and long chute element 12 is shown rotatably engaged with hinge pin element 22.

FIG. 5 also shows the curved areas c and d of the long chute element 12. The curved area c is shown engaging the adjacent short chute elements 13 along its side edges, identified as f and g. The curved area c may sweep through an arc of substantially 90 degrees, and when a bag is held in the holder for filling, this curved area extends behind edges f and g of adjacent short chute elements 13 providing an overlap. The curved areas c preferably are on both ends of long chute elements 11 and 12, and preferably serve three functions: (1) to prevent the over-rotation of the short chute elements 13 and 14 when mounting a bag; (2) to prevent the leakage of material during the process of filling a bag; and (3) to protect the mouth of a bag from being torn as objects are introduced into the bag.

Clearly shown is the contact between long chute element 12 and short chute element 13. Short chute element 13 is preferably held in contact with long chute element 12 by raised bump a on long chute element 12 contacting short chute element 13 along edge f.

Also shown in the figure is curved region d. Curved region d may sweep through an arc of 90 degrees. The curved portion d preferably provides a curved surface around which a bag may be stretched, preferably preventing the concentration of force in a small area that may otherwise cut or tear the bag. Curved regions d and raised bumps a are preferably located at both ends of long chute elements 11 and 12.

Edges h of long chute elements 11 and 12 preferably are the areas of contact between the long chute elements and a bag, which serve to hold a bag open and seize it to the holder.

Figures 6, 7, 8, 9:
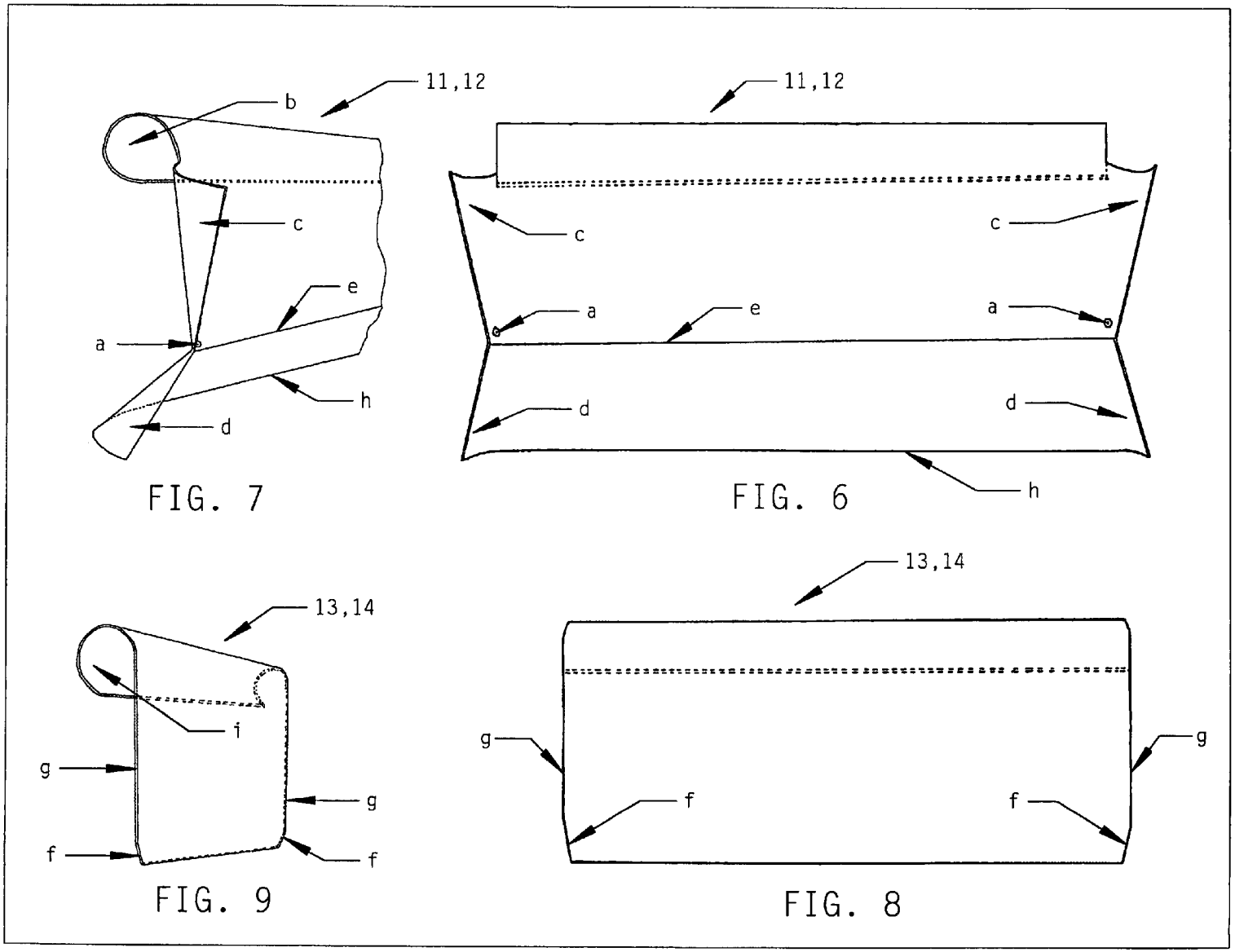
FIG. 6 shows an elevation view of one piece of the chute of FIG. 1.
FIG. 7 shows a partial perspective view of an edge of the chute of FIG. 6.
FIG. 8 shows an elevation view of another piece of the chute of FIG. 1.
FIG. 9 shows a perspective view of an edge of the chute of FIG. 8.

FIGS. 6 shows long chute elements 11 and 12, which are substantially identical to each other. FIG. 6 shows raised bumps, identified as a, which hold the short chute elements 13 and 14 along their edges f in position nested against the upper curved portions c of long chute elements 11 and 12.

Preferably, the raised bumps a on long chute elements 11 and 12 are raised sufficiently so that the short chute elements 13 and 14 will not inadvertently pop out of position during ordinary use, yet will permit release of the short chute elements 13 and 14 by hand action of the operator. It is clear that someone skilled in the art may alternatively use friction, spring clips, detents, or engagement means, not shown, other than raised bumps a on long chute elements 11 and 12 to hold short chute elements 13 and 14 in position. Also shown are curved regions c and d.

FIG. 7 shows hinge area b of the long chute elements 11 and 12 wrapping around in an arc. The hinge area b preferably sweeps through an arc of greater than 180 degrees, so that the long chute elements 11 and 12 can firmly grasp their corresponding hinge pin elements 21 and 22, so as not to become separated from hinge pin elements 21 and 22 during use. If removed from hinge pin elements 21 and 22, the inside diameter of hinge area b of the long chute elements 11 and 12 is preferably slightly smaller than the outside diameter of the hinge pin elements 21 and 22. When each long chute element 11 and 12 is mounted on its corresponding hinge pin element 21 and 22, each long chute element's hinge area b embraces or grips the corresponding hinge pin elements 21 and 22. Preferably, the tension creating the grip is sufficient such that friction exists between the parts. Preferably, the friction is sufficient such that each long chute element 11 and 12 may be rotated to any position on the corresponding hinge pin elements 21 and 22 and it will maintain that position until moved to a different position by the hand action of the operator.

FIG. 7 shows a view of the curved areas c and d of the long chute elements 11 and 12. The curved areas c are nearest to the hinge area b of the long chute elements 11 and 12, and engage the adjacent short chute elements 13 and 14 along their side edges, identified in FIGS. 5, 8 and 9 as f and g.

The other curved portions of the long chute elements 11 and 12 that are farther from the hinge area b, identified in FIGS. 7 as d, also preferably sweep through an arc of 90 degrees. The curved portions d provide a curved corner, around which a bag is preferably stretched, preferably preventing the concentration of force in a small area that may otherwise cut or tear the bag.

Preferably, substantially the entire region of each long chute element 11 and 12 located between curved portions d is preferably angled approximately 45 degrees, along the line identified as e, with respect to the region located between curved portions c. This preferably causes edge h to contact the inside surface of a bag when the chute elements are in position for holding a bag open for filling. This angle along line e preferably permits the lower portion of the long chute elements 11 and 12 between regions d to flex while under tension, providing a spring action to keep a bag under a suitable load, holding the bag in the holder. To facilitate this spring action, long chute elements 11 and 12 may be constructed from an elastically deformable material. The material from which long chute elements 11 and 12 may be constructed may also be thinned along line e to encourage flexing along this line.

Preferably, the angle between the two planes of each long chute element 11 and 12 that meet along e is also approximately 45 degrees. When outward force is applied to each long chute element 11 and 12, the line of contact between the extreme lower edge of each long chute element 11 and 12, identified as h, and the inside surface of the bag occurs down into the bag, away from the extreme top edge or mouth of the bag. Essentially no force is applied to the bag mouth. This preferably prevents the outward force applied by long chute elements 11 and 12 from tearing the opening of the bag. The edges h may be coated with rubber, grit or other substances, or serrated, so that there is increased friction or traction with the inside of the bag. Furthermore, the edges h may be radiused or curved downward and away from the bag to expose a greater surface area of long chute elements 11 and 12 to contact with a greater surface area of the bag, providing increased friction with the bag, and reducing chances of piercing, cutting or tearing the bag.

The chutes as illustrated are acceptable for many applications. For example, the illustrated embodiments may be advantageously used for bags carrying light loads such as grass clippings. Further, the illustrated embodiments typically only require a modest force to engage the chute elements 11, 12, 13, and 14. If, however, a heavier load is carried in the bag then using four long chutes may be preferable. In doing so, the bumps or detents may need to be changed. For example, the amount of spring force generated by the flex between curved portions d along line e determines the force to keep the short chute elements 13 and 14 from popping past bumps a during ordinary use. With two long chutes 11 and 12 and two short chutes 13 and 14, the force to prevent the short chutes 13 and 14 from popping past bumps a is proportional to the spring force of the two long chutes 13 and 14. In an embodiment having four long chutes and no short chutes, flex from all four of the long chutes would contribute to the total spring force. Thus in this embodiment, the force to prevent the chutes from popping past the bumps a is proportional to the spring force of four long chutes. Typically, this embodiment would have more robust bumps, detents, or engagement elements to counter the greater force generated by the four long chute elements. Making all four chute elements long, together with more robust bumps, detents, or other engagement elements provides increased holding power for securing a bag. This embodiment would be advantageous in more demanding situations, such as those requiring more robust compacting of material into a bag or loading of heavier, denser or bulkier material.

FIG. 8 shows an elevation view of short chute elements 13 and 14. Short chute elements 13 and 14 are substantially identical to each other. FIG. 8 readily shows the beveled lower edges, identified as f, which preferably are made to fit and follow the slope defined by the long chute elements 11 and 12 along their line of contact while the chute elements are in position to hold a bag. Edges g are also visible.

FIG. 9 clearly shows that the hinge area of the short chute elements 13 and 14, identified as i, wraps around in an arc substantially identical to that of hinge area b of long chute elements 11 and 12. The hinge area i preferably sweeps through an arc of greater than 180 degrees, so that the short chute elements 13 and 14 firmly grasp their corresponding hinge pin elements 23 and 24 so as not to become separated from hinge pin elements 23 and 24 during use. If short chute elements 13 and 14 are removed from hinge pin elements 23 and 24, the inside diameter of hinge areas i of the short chute elements 13 and 14 is preferably slightly smaller than the outside diameter of hinge pin elements 23 and 24. When each short chute element 13 and 14 is mounted on its corresponding hinge pin element 23 and 24, short chute elements 13 and 14 hinge areas i embrace or grip hinge pin elements 23 and 24. The tension creating the grip is preferably sufficient such that friction exists between the parts. Preferably, the friction is sufficient such that short chute elements 13 and 14 may be rotated to any position on hinge pin elements 23 and 24 and it will maintain that position until moved to a different position by the hand action of the operator.

Figures 10, 11, 12, 13, 14:
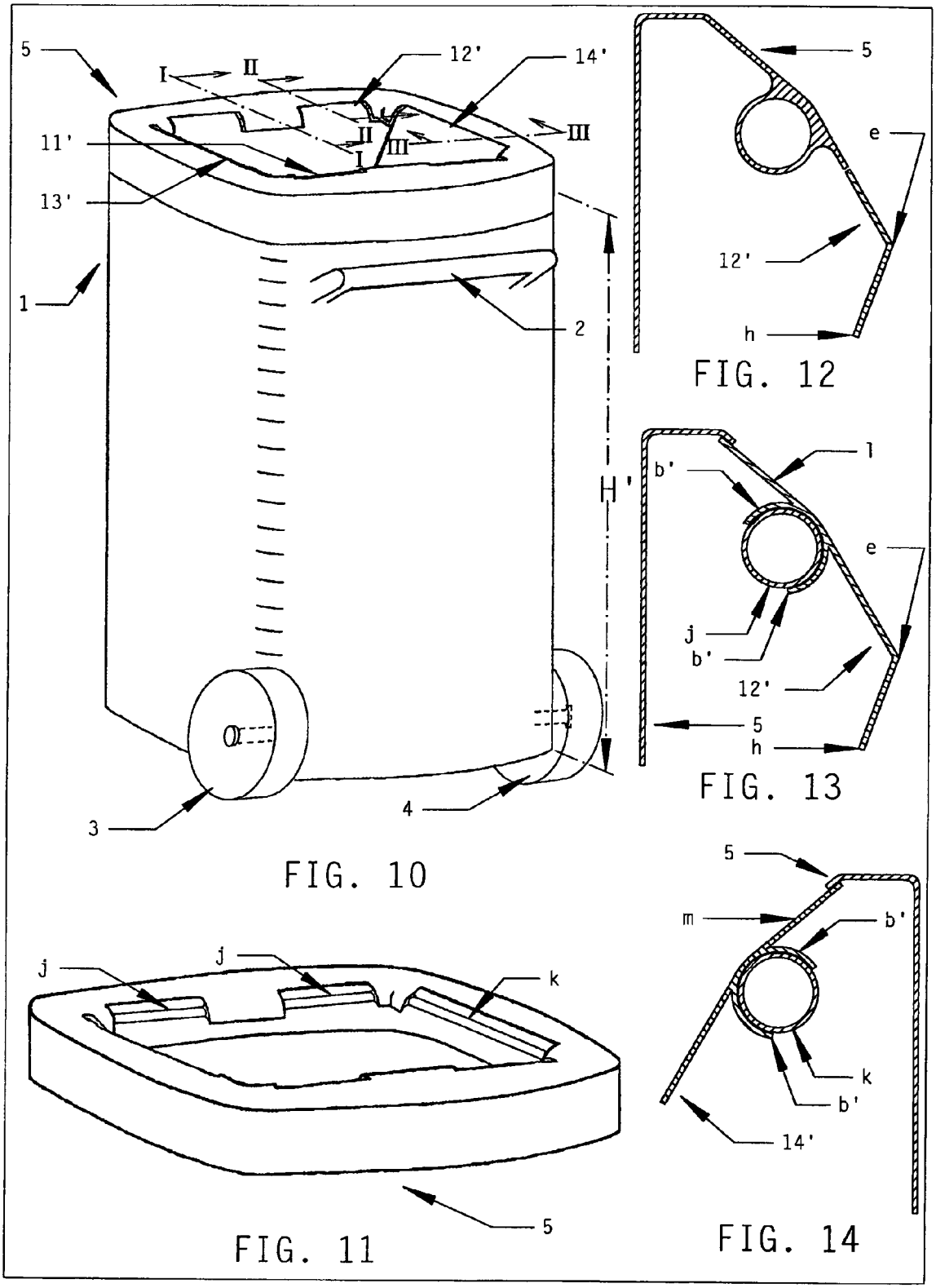
FIG. 10 shows a perspective view of a second embodiment of the bag holder of FIG. 1.
FIG. 11 shows a perspective view of the lid element of FIG. 10 with the chute omitted for clarity.
FIG. 12 shows a cross sectional view along section line I-I of FIG. 10.
FIG. 13 shows a cross sectional view along section line II-II of FIG. 10.
FIG. 14 shows a cross sectional view along section line III-III of FIG. 10.

FIG. 10 shows a second embodiment, comprising a can element 1, similar to a trash can, possessing a handle element 2 and wheel elements 3-4. Preferably, can element 1 is of sufficient internal dimensions to contain a bag, and may be utilized in place of the four leg elements 41-44. It is understood from FIG. 10 that the four leg elements 41-44, the four hinge pin elements 21-24, and the four connecting elements 31-34 of the first embodiment may be dispensed with altogether, in favor of the can element 1 and lid element 5, as shown in FIG. 10. The second embodiment as shown by FIGS. 10-17 is directed to use of a chute similar to that of the first embodiment, on the lid element 5 of can element 1. Features of the second embodiment which are identical to those of the first embodiment are labeled as in the first embodiment.

FIG. 11 depicts lid element 5 with the chute elements removed for clarity. Lid element 5 has hinge pin elements j which may be rotatably engaged by hinge areas b' of long chute elements 11' and 12'. Long chute elements 11' and 12' differ from long chute elements 11 and 12 of the first embodiment primarily in that the means for rotatably engaging the lid element 5 may be slightly different from those employed in the first embodiment to rotatably engage hinge pin elements 21-22, and that long chute elements 11' and 12' have areas 1 added to engage lid element 5 by being overlapped by lid element 5 to prevent spillage of material into can element 1 as the material is introduced into the bag. Areas 1 additionally may serve to enlarge the funnel area of the chute to an area that is greater than that defined by the hinge pin elements to more readily admit the addition of material to the bag and reduce the opportunity for spillage.

Lid element 5 also has hinge pin elements k which may be rotatably engaged by hinge areas b' of short chute elements 13' and 14'. Short chute elements 13' and 14' differ from short chute elements 13 and 14 of the first embodiment primarily in that the means for rotatably engaging the lid element 5 may be slightly different from those employed in the first embodiment to rotatably engage hinge pin elements 23-24, and that long chute elements 13' and 14' have areas m added to engage lid element 5 by being overlapped by lid element 5 to prevent spillage of material into can element 1 as the material is introduced into the bag. Areas m additionally may serve to enlarge the funnel area of the chute to an area that is greater than that defined by the hinge pin elements to more readily admit the addition of material to the bag and reduce the opportunity for spillage.

FIG. 12 is a section along line I-I of FIG. 10, showing the relationship between long chute element 12' and lid element 5. The long chute element 12' depicted in this figure is in position for holding a bag for filling.

FIG. 13 is a section along line II-II of FIG. 10, showing the relationship between long chute element 12' and lid element 5. The long chute element 12' depicted in this figure is in position for holding a bag for filling. Also depicted is long chute element 12' rotationally engaged by its hinge areas b' to lid element 5's hinge pin element j. Further depicted is area 1 of long chute element 12', which is preferably overlapped by lid element 5 to prevent the leakage of material that is added to the bag.

FIG. 14 is a section along line III-III of FIG. 10, showing the relationship between short chute element 14' and lid element 5. Short chute element 14' depicted in this figure is in position for holding a bag for filling. Also depicted is short chute element 14' rotationally engaged by its hinge areas b' to lid element 5's hinge pin element k. Further depicted is area m of short chute element 14', which may be overlapped by lid element 5 to substantially prevent the leakage of material that is added to the bag.

Figures 15, 16, 17, 18:
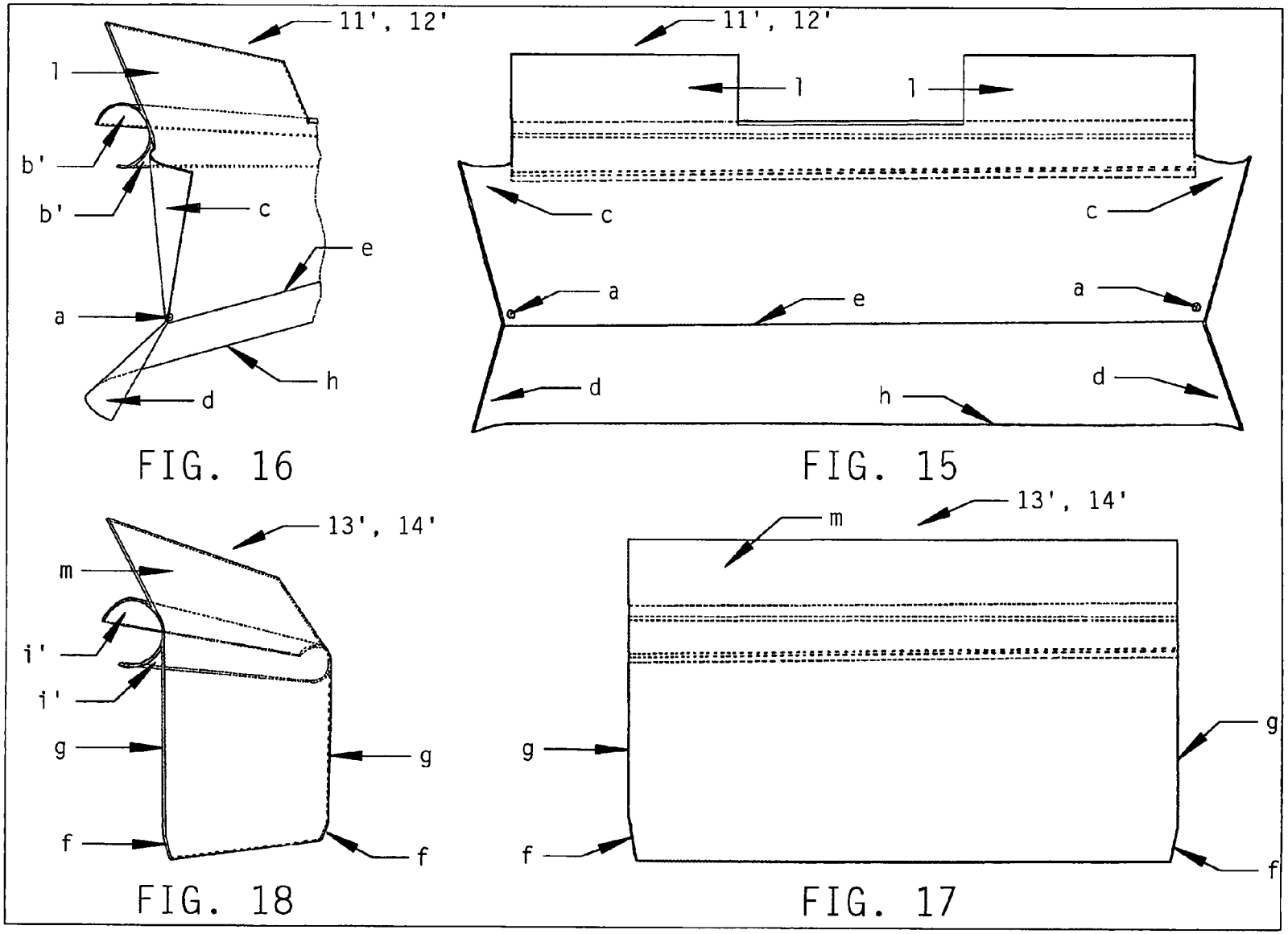
FIG. 15 shows an elevation view of one chute element of FIG. 10.
FIG. 16 shows a partial perspective view of an edge of the one chute element of FIG. 15.
FIG. 17 shows an elevation view of another chute element of FIG. 10.
FIG. 18 shows a perspective view of the chute element of FIG. 17.

FIG. 15 shows long chute elements 11' and 12' of the second embodiment of FIG. 10. Long chute elements 11' and 12' are substantially identical to each other. Long chute elements 11' and 12' are nearly identical to long chute elements 11 and 12 of the first embodiment, differing in primarily two respects.

The first difference is that long chute elements 11' and 12' have areas 1 added to them that are not found on long chute elements 11 and 12. Areas 1 may be provided on long chute elements 11' and 12' in the second embodiment so that when a bag is held open for filling, material being added to the bag will preferably not leak between the exterior of the bag and the interior of can element 1. The second difference is the distinction between hinge area b of long chute elements 11 and 12, and the hinge areas b' of long chute elements 11' and 12'. Both hinge areas serve to rotationally engage the long chute elements to their respective hinge pin elements, the slight change being needed to accommodate the addition of areas 1 to long chute elements 11' and 12'. Essentially all other elements and areas of the long chute elements are identical between 11, 12, 11' and 12', serve essentially the same function, and are labeled identically.

FIG. 16 shows a partial perspective view of the long chute elements 11' and 12' of FIG. 15. This view clearly shows the addition of areas 1, and how they cause hinge areas b' of long chute elements 11' and 12' to differ from hinge area b of long chute elements 11 and 12.

Despite these slight differences, the function of these areas is essentially identical. That is, to rotationally engage their respective hinge pin elements. Preferably, the hinge areas b' sweep through an arc of greater than 180 degrees, so that the long chute elements 11' and 12' can firmly grasp their corresponding hinge pin areas j of lid element 5, so as not to become separated from hinge pin areas j during use. If removed from hinge pin areas j, the inside diameter of hinge areas b' of the long chute elements 11' and 12' is preferably slightly smaller than the outside diameter of the hinge pin areas j. When each long chute elements 11' and 12' is mounted on its corresponding hinge pin area j, each long chute element's hinge areas b' preferably embrace or grip the corresponding hinge pin area j. Preferably, the tension creating the grip is sufficient such that friction exists between the parts. Preferably, the friction is sufficient such that each long chute element 11' and 12' may be rotated to any position on the corresponding hinge pin areas j and it will maintain that position until moved to a different position by the hand action of the operator.

Also shown are the curved areas c and d of the long chute elements 11' and 12'. The curved areas c are nearest to the hinge area b' of the long chute elements 11' and 12', and engage the adjacent short chute elements 13' and 14' along their side edges, identified in FIGS. 17 and 18 as f and g. Curved areas c are substantially identical in both embodiments.

The other curved portions of the long chute elements 11' and 12' that may be farther from the hinge area b', identified in FIGS. 7 as d, also preferably sweep through an arc of 90 degrees. The curved portions d provide a curved corner, around which a bag is preferably stretched, preferably preventing the concentration of force in a small area that may otherwise cut or tear the bag. Curved areas d are also substantially identical in both embodiments.

Just as with long chute elements 11 and 12 of the first embodiment, preferably the entire region of each long chute element 11' and 12' located between curved portions d is angled approximately 45 degrees, along the line identified as e, with respect to the region located between curved portions c. Preferably, this causes edge h to contact the inside surface of a bag when the chute elements are in position for holding a bag open for filling. Preferably, this angle along line e permits the lower portion of the long chute elements 11' and 12' between regions d to flex while under tension, providing a spring action to keep a bag under an ideal load, holding the bag in the holder. To facilitate this spring action, long chute elements 11' and 12' may be constructed from an elastically deformable material. The material from which long chute elements 11' and 12' is constructed may also be thinned along line e to encourage flexing along this line.

Preferably, the angle between the two planes of each long chute element 11' and 12' that meet along e is approximately 45 degrees also so that when outward force is applied to each long chute element 11' and 12', the line of contact between the extreme lower edge of each long chute element 11' and 12', identified as h, and the inside surface of the bag occurs down into the bag, away from the extreme top edge or mouth of the bag. Essentially, no force is applied nearer to the bag mouth. Preferably, this prevents the outward force applied by long chute elements 11' and 12' from tearing the opening of the bag. The edges h may be coated with rubber, grit or other suitable material, or serrated, to enhance the friction with the inside of the bag. The edges h may be radiused or curved away from the bag to expose a greater surface area of long chute elements 11' and 12' to contact with a greater surface area of the bag, providing increased friction with the bag, and reducing chances of piercing, cutting or tearing the bag.

FIG. 17 shows an elevation view of short chute elements 13' and 14'. Short chute elements 13' and 14' are substantially identical to each other. Short chute elements 13' and 14' are nearly identical to short chute elements 13 and 14 of the first embodiment, differing in primarily two respects.

The first difference is that short chute elements 13' and 14' have area m added to them that is not found on short chute elements 13 and 14. Area m may be provided in the second embodiment on short chute elements 13' and 14' so that when a bag is held open for filling, material being added to the bag preferably will not leak between the exterior of the bag and the interior of can element 1. The second difference is the distinction between hinge area i of short chute elements 13 and 14, and the hinge areas i' of short chute elements 13' and 14'. Both hinge areas serve to rotationally engage the short chute elements to their respective hinge pin elements, the slight change to accommodate the addition of area m to short chute elements 13' and 14'.

Preferably, all other elements and areas of the short chute elements are substantially identical between 13, 14, 13' and 14' and serve the same function, and are labeled identically.

FIG. 17 also readily shows the beveled lower edges, identified as f, which are made to substantially fit and follow the slope defined by the long chute elements 11' and 12' along their line of contact while the chute elements are in position to hold a bag. Edges g are also visible.

FIG. 18 shows a perspective view of the short chute elements 13' and 14' of FIG. 17. This view clearly shows the addition of area m, and how it cause hinge areas i' of short chute elements 13' and 14' to differ from hinge area i of short chute elements 13 and 14.

Despite these slight differences, the function of these areas is essentially identical, to rotationally engage their respective hinge pin elements. Preferably, the hinge areas i' sweep through an arc of greater than 180 degrees, so that the short chute elements 13' and 14' can firmly grasp their corresponding hinge pin areas k of lid element 5, so as not to become separated from hinge pin areas k during use. If removed from hinge pin areas k, the inside diameter of hinge areas i' of the short chute elements 13' and 14' is preferably slightly smaller than the outside diameter of the hinge pin areas k. Preferably, when each short chute elements 13' and 14' is mounted on its corresponding hinge pin area k, each short chute element's hinge areas i' embrace or grip the corresponding hinge pin area k. Preferably, the tension creating the grip is sufficient such that friction exists between the parts. Preferably, the friction is sufficient such that each short chute element 13' and 14' may be rotated to any position on the corresponding hinge pin areas k and it will maintain that position until moved to a different position by the hand action of the operator.

Use of the Preferred Embodiments

In a preferred method of operating either embodiment of the invention, the following steps shall preferably be undertaken in order. First, the operator places the invention on a level surface, typically the ground, in the area where a bag shall be filled. Irrespective of their current positioning, the operator preferably grasps the lower edges of short chute elements 13 and 14, and rotates them about the two hinge pin elements 23 and 24, until, they are substantially perpendicular in their orientation with the plane of the ground. They may also be rotated such that they point away from perpendicular in a direction that is outward from the invention. Preferably, once the short chute elements 13 and 14 have been rotated, the operator repeats this action with the two long chute elements 11 and 12.

Preferably, after having rotated the four chute elements 11-14 outside of the hinge pin elements 21-24, the operator then lowers a fully opened bag of sufficient size into the bag stand.

Once a bag has been positioned within the bag holder, the operator preferably shall then proceed to sequentially rotate each long chute elements 11 and 12 into the open mouth of the bag. After having rotated both long chute elements 11 and 12 into the bag, the operator then shall preferably proceed to rotate, either sequentially or simultaneously, the two short chute elements 13 and 14 into the open mouth of the bag.

As the short chute elements 13 and 14 are rotated into the open mouth of the bag, the operator will find that the beveled side edges f of short chute elements 13 and 14 will contact the long chute elements 11 and 12. Upon achieving contact, the operator will preferably note that continued rotation of the short chute elements 13 and 14 forces the two long chute elements 11 and 12 outwards, or away from each other. This "camming" action continues to move the long chute elements 11 and 12 outwards.

Preferably, as the operator continues rotating the short chute elements 13 and 14, the long chute elements 11 and 12 move farther outward until the lower edges h of the long chute elements 11 and 12 project towards the interior surface of the bag, and contact the interior surface of the bag down from the top opening of the bag. Preferably, as the short chute elements 13 and 14 rotate even further, a point may be reached where the lower edges of long chute elements 11 and 12 may move no further outward, having stretched the bag mouth fully open.

Preferably, at this point, the short chute elements 13 and 14 may still be rotated further downward and outward. Since the circumference of the bag has substantially prevented further outward movement of the lower edges of the long chute elements 11 and 12, the continued rotation of the short chute elements 13 and 14 preferably causes the long chute elements 11 and 12 to flex. Preferably, since the long chute elements 11 and 12 are constructed of a elastically deformable material, the flexing of long chute elements 11 and 12 provides a constant, evenly distributed outward pressure against the inside of the bag. The long chute elements 11 and 12 may be effectively spring-loaded against the interior surface of the bag.

Preferably, the invention is constructed to dimensions such that when an outward pressure sufficient to hold a bag in position, yet not burst the bag, may be provided by the flexing of long chute elements 11 and 12, the short chute elements 13 and 14 reach their limit of rotation. Preferably, the rotation of short chute elements 13 and 14 may be limited by their straight edges g coming into contact with the upper curved sections c of long chute elements 11 and 12. Preferably, this occurs immediately after the short chute elements 13 and 14 have moved beyond the raised bumps a on the long chute elements 11 and 12. In order that the energy stored by the flexing of long chute elements 11 and 12 not drive short chute elements 13 and 14 upwards and out, (thereby loosening the holding force on the bag, causing it to be released), the raised bumps a provided in the face of long chute elements 11 and 12 retain the short chute elements 13 and 14 in position.

The bag may be now firmly grasped by the various embodiments of the invention, and may be filled with material.

In order to release a bag from the invention, the operator preferably grasps the lower edges of the two short chute elements 13 and 14, and at first pulls them both towards each other, then rotates the short chute elements 13 and 14 upwards and out of the bag mouth. The operator then repeats this action with long chute elements 11 and 12. At this point, the bag is now free from the chute of the invention. Unlike other bag stands that require lifting a filled bag up and out of a holder or container, the first embodiment of the invention preferably requires only that the lightweight holder be slid to the side, leaving the bag free to be removed for disposal. Lifting the bag is typically not necessary. At this point, the invention is free to receive a new bag. With the second embodiment of the invention, lid element 5 may be removed from can element 1, set to the side, and the bag may either be lifted out of can element 1, or can element 1 may be laid upon its side and the bag pulled out of can element 1. Lid element 5 may then be restored to the opening of can element 1, and the holder given a new bag to hold.

Operation of the chute elements of the second embodiment of the invention is substantially the same as the operation of those of the first embodiment.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

The invention claimed is:

1. A holder for a bag, comprising chute elements adapted to rotatably engage the bag for opening the bag when frictionally engaging interior surfaces of the bag, wherein the chute elements comprise at least a first chute element that imparts force to at least a second chute element, the second chute element providing force to keep the bag open, wherein the force is imparted from a lower edge of the first chute element to at least the second chute element upon rotation of the first chute element relative to the second chute element, and wherein rotation of the first chute element causes rotation of the second chute element.

2. The holder according to claim 1, wherein at least one of the chute elements has a stop element for limiting rotation of the chute elements, when the chute elements have engaged sides of the bag in the holder.

3. The holder according to claim 2, wherein said stop element comprises a first set of curved edges on ends of the second chute element which overlap ends of the first chute element.

4. The holder according to claim 3, wherein a second set of curved edges are curved at opposite ends to prevent piercing the bag.

5. The holder according to claim 1, wherein the chute elements are adapted to cover an entire perimeter of a mouth of the bag.

6. The holder according to claim 2, wherein the first chute element has an engagement element for maintaining the second chute element in engagement with the first chute element, and the edge in engagement with the bag, after rotation of the second chute element has been limited by the stop element.

7. The holder according to claim 1, wherein the second chute element is longer than the first chute element and wherein a lower portion of the second chute element contacts the bag substantially below the top edge of the bag.

8. The holder according to claim 7, wherein the lower portion of the second chute element is angled outwardly to apply force to the bag.

9. The holder according to claim 8, wherein the angle is approximately 45 degrees.

10. The holder according to claim 1, wherein at least one of the chute elements is made from an elastically deformable material.

11. The holder according to claim 10, wherein at least one chute element forces another of the chute elements to deform.

12. The holder according to claim 1, further comprising a support wherein the support comprises a cart or truck.

* * * * *